US008192166B2

(12) United States Patent
Beeck et al.

(10) Patent No.: US 8,192,166 B2
(45) Date of Patent: Jun. 5, 2012

(54) TIP SHROUDED TURBINE BLADE WITH SEALING RAIL HAVING NON-UNIFORM THICKNESS

(75) Inventors: Alexander R. Beeck, Orlando, FL (US); Sankar Nellian, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 474 days.

(21) Appl. No.: 12/464,492

(22) Filed: May 12, 2009

(65) Prior Publication Data

US 2010/0290897 A1 Nov. 18, 2010

(51) Int. Cl.
*F01D 5/22* (2006.01)

(52) U.S. Cl. ..... 416/191; 415/173.6

(58) Field of Classification Search ..... 416/191, 416/189, 192, 97 R; 415/173.4, 173.6
See application file for complete search history.

(56) References Cited

U.S. PATENT DOCUMENTS

| | | | | |
|---|---|---|---|---|
| 5,120,197 | A | 6/1992 | Brooks et al. | |
| 6,120,249 | A | 9/2000 | Hultgren et al. | |
| 6,241,471 | B1 | 6/2001 | Herron | |
| 6,805,530 | B1 * | 10/2004 | Urban | 415/173.4 |
| 6,962,342 | B2 | 11/2005 | Wieghardt | |
| 7,094,023 | B2 * | 8/2006 | Dube et al. | 415/173.1 |
| 7,273,353 | B2 * | 9/2007 | Dube et al. | 416/192 |
| 7,465,152 | B2 * | 12/2008 | Nigmatulin | 415/170.1 |
| 7,901,180 | B2 * | 3/2011 | Abdel-Messeh et al. | 416/1 |
| 2005/0058539 | A1 | 3/2005 | Diakunchak | |
| 2007/0020102 | A1 | 1/2007 | Beeck et al. | |
| 2008/0166240 | A1 | 7/2008 | Scott et al. | |

* cited by examiner

*Primary Examiner* — Nathan Ha

(57) ABSTRACT

A turbine blade is provided comprising: an airfoil including upper and lower ends; a root coupled to the airfoil lower end; a shroud coupled to the airfoil upper end; and at least one sealing rail extending radially outwardly from an upper surface of the shroud and extending generally along a circumferential length of the shroud. The sealing rail may comprise a mid-section, opposing end sections and at least one intermediate section located between the mid-section and one of the opposing end sections. An axial thickness of the rail may vary.

20 Claims, 5 Drawing Sheets

TIP SHROUDED TURBINE BLADE WITH SEALING RAIL HAVING NON-UNIFORM THICKNESS

FIELD OF THE INVENTION

The present invention relates to tip shrouded turbine blades and, more particularly, to such blades having a sealing rail with a thickness that varies along a length of the rail in a circumferential direction.

BACKGROUND OF THE INVENTION

U.S. Pat. No. 6,805,530 discloses an airfoil having a tip shroud and a seal extending radially from the shroud. A cutter tooth is located along the seal, between opposing ends of the shroud and in substantial radial alignment with a center of mass of the airfoil.

U.S. Pat. No. 6,241,471 discloses an airfoil having a tip shroud and a seal rail. Reinforcing bars are provided, each of which extends from the shroud to the seal rail, so as to stiffen the shroud.

SUMMARY OF THE INVENTION

In accordance with a first aspect of the present invention, a turbine blade is provided comprising: an airfoil including upper and lower ends; a root coupled to the airfoil lower end, the root adapted to couple the blade to a rotatable disk; a shroud coupled to the airfoil upper end; and at least one sealing rail extending radially outwardly from an upper surface of the shroud and extending generally along a circumferential length of the shroud. The sealing rail may comprise a mid-section, opposing end sections and at least one intermediate section located between the mid-section and one of the opposing end sections. An axial thickness of the rail may vary such that the mid-section has a first thickness, the intermediate section has a second thickness and the one end section has a third thickness. The first thickness may be greater than the second thickness and the second thickness may be greater than the third thickness.

The sealing rail mid-section may be radially positioned in-line with the airfoil.

The sealing rail mid-section may comprise first and second generally planar surfaces spaced apart from one another in the axial direction.

The sealing rail may have first and second outer surfaces. The first outer surface may have first and second sections each having a generally parabolic shape in a plane extending in the axial and circumferential directions.

The first and second generally parabolic sections may meet at a first point located at the mid-section.

The second outer surface may have third and fourth sections each having a generally parabolic shape in the plane extending in the axial and circumferential directions.

The third and fourth generally parabolic sections may meet at a second point located at the mid-section.

The first and second points may be spaced apart from one another in the circumferential direction.

The at least one sealing rail may comprise first and second sealing rails. Each of the rails may have an axial thickness varying such that a mid-section has a first thickness, an intermediate section has a second thickness and one of opposing end sections has a third thickness. The first thickness may be greater than the second thickness and the second thickness may be greater than the third thickness.

The intermediate section may be spaced circumferentially from the airfoil.

In accordance with a second aspect of the present invention, a turbine is provided comprising at least one row of circumferentially engaging tip shrouded blades. Each blade may comprise: an airfoil including upper and lower ends; a root coupled to the airfoil lower end, the root adapted to couple the blade to a rotatable disk; a shroud coupled to the airfoil upper end; and at least one sealing rail extending radially outwardly from an upper surface of the shroud and extending generally along a circumferential length of the shroud. The sealing rail may comprise a mid-section, opposing end sections and at least one intermediate section located between the mid-section and one of the opposing end sections. An axial thickness of the rail may vary such that the mid-section has a first thickness, the intermediate section has a second thickness and the one end section has a third thickness. The first thickness may be greater than the second thickness and the second thickness may be greater than the third thickness.

DETAILED DESCRIPTION OF THE INVENTION

Figure 1:
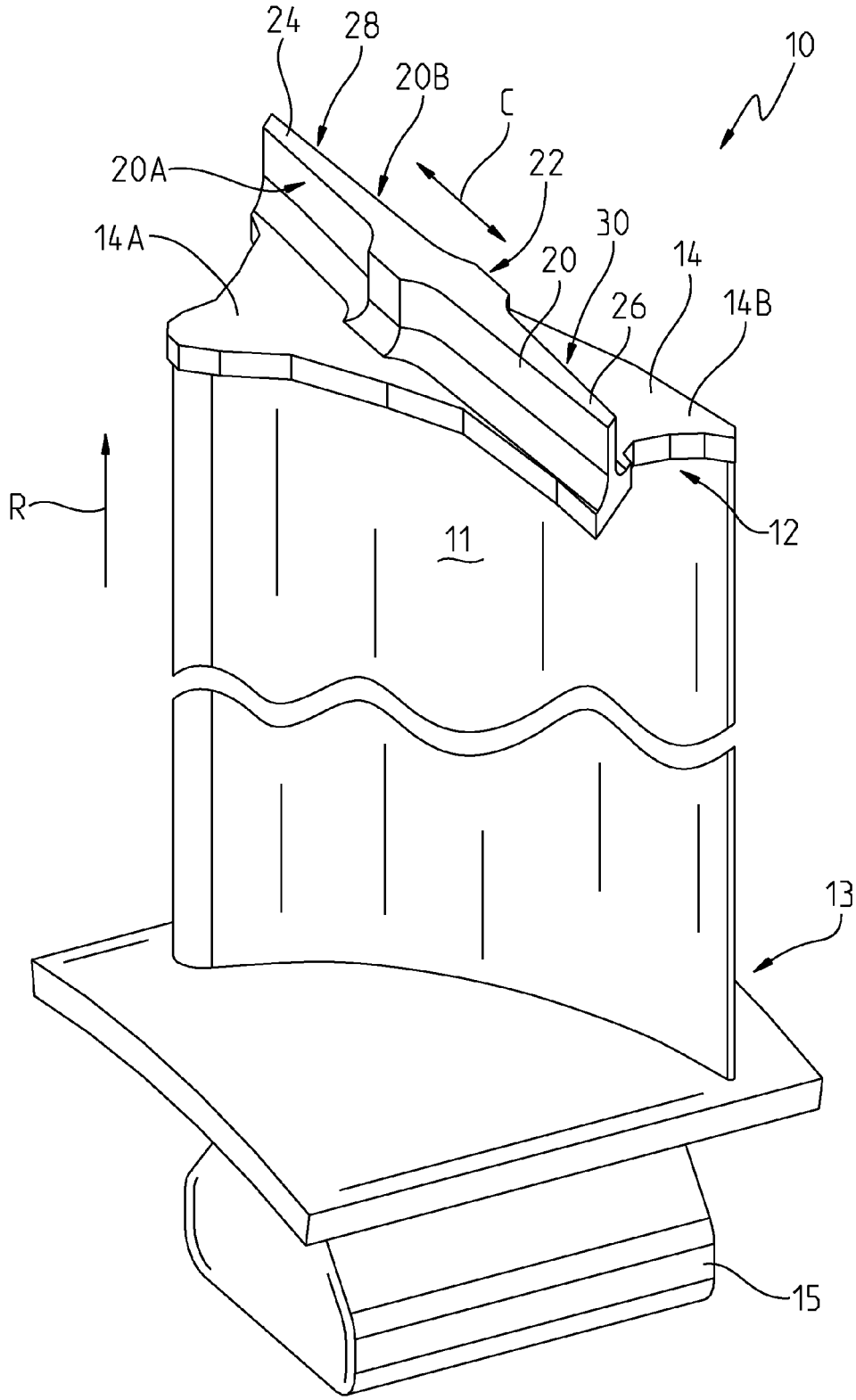
FIG. 1 is a perspective view of a gas turbine blade including a sealing rail constructed in accordance with a first embodiment the present invention.

Referring now to FIG. 1, a gas turbine blade 10 constructed in accordance with a first embodiment of the present invention is illustrated. The blade 10 is adapted to be used in a gas turbine (not shown) of a gas turbine engine (not shown). Within the gas turbine are a series of rows of stationary vanes and rotating blades. It is contemplated that the blade 10 illustrated in FIG. 1 may define the blade configuration for rear rows of blades in the gas turbine.

The blades are coupled to a shaft and disc assembly (not shown). Hot working gases from a combustor (not shown) in the gas turbine engine travel to the rows of blades. As the working gases expand through the turbine, the working gases cause the blades, and therefore the shaft and disc assembly, to rotate.

The turbine blade 10 comprises an airfoil 11 including an upper end 12 and a lower end 13. A root 14 is coupled to the airfoil lower end 13. The root 14 couples the blade 10 to the rotatable disk (not shown) of the shaft and disc assembly. The blade 10 further comprises a tip shroud 14 coupled to the airfoil upper end 12. The tip shroud 14 functions to keep hot working gases away from an engine casing and further functions to prevent the hot gases from passing over the airfoil upper end. In the embodiment illustrated in FIG. 1, a single sealing rail 20 extends radially outwardly from an upper surface 14A of the shroud 14, see arrow R in FIG. 1 indicating a radial direction, and extends generally along a circumferential length of the shroud 14, see arrow C in FIG. 1 indicating a circumferential direction. The sealing rail 20 extends into a groove 200A, see FIG. 2, in a stationary honeycomb sealing structure 200 defining a part of the engine casing and functions to prevent hot working gases from passing through a gap between the airfoil upper end 12 and the sealing structure 200.

Figure 3:
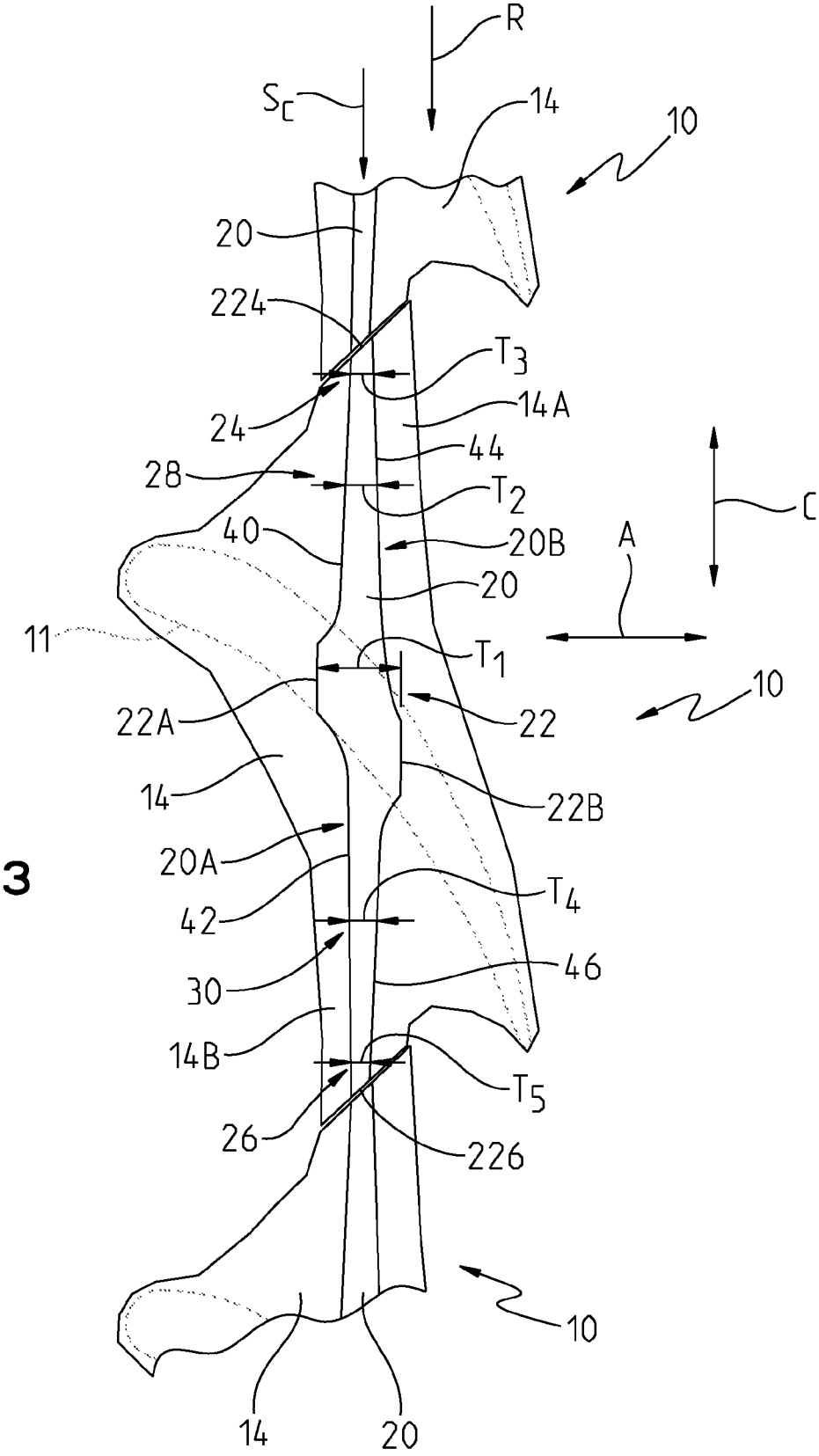
FIG. 3 is top view of one blade and portions of two other blades each including a sealing rail constructed in accordance with the first embodiment of the present invention.

In FIG. 3, a row R of blades 10 is illustrated. The blades 10 are positioned such that adjacent tip shrouds 14 on the blades 10 engage with one another. Also, adjacent sealing rails 20 on adjacent blades 10 are aligned with one another in the circumferential direction C so as to define a circumferential seal $S_C$ for the row R of blades 10.

Figure 2:
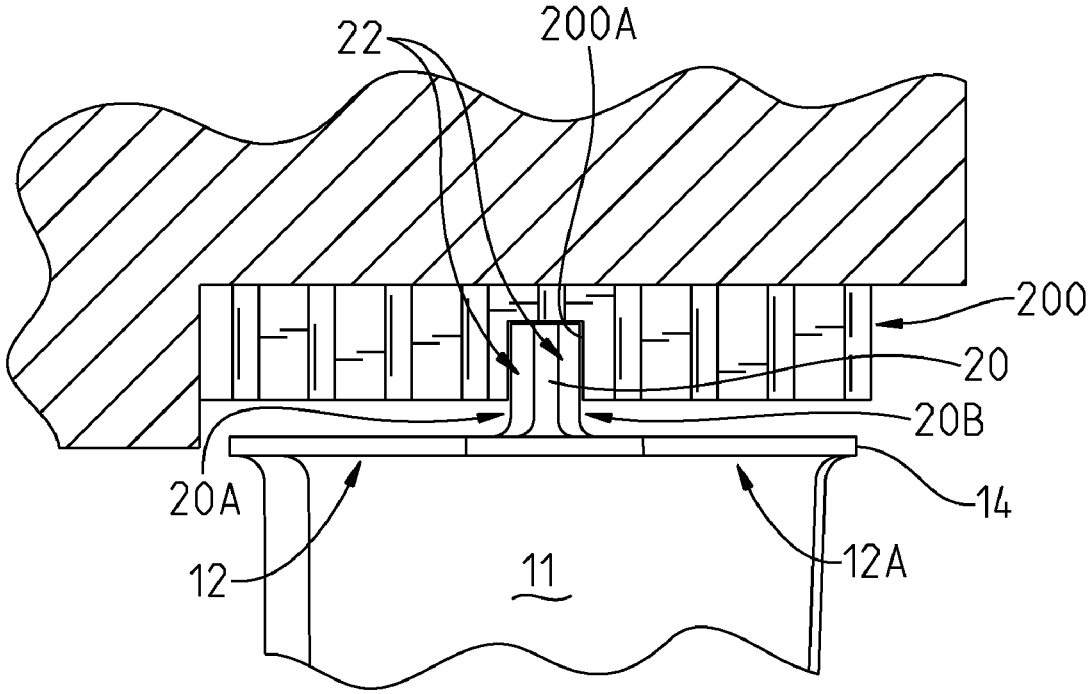
FIG. 2 is a view illustrating the blade in FIG. 1 in engagement with a stationary honeycomb sealing structure.

In the embodiment illustrated in FIGS. 1-3, the sealing rail 20 comprises first and second outer surfaces 20A and 20B. The sealing rail 20 further comprises a mid-section 22, first and second opposing end sections 24 and 26, respectively, and first and second intermediate sections 28 and 30, respectively, located between the mid-section 22 and a corresponding one of the opposing end sections 24 and 26, see FIGS. 1 and 3. As is apparent from FIG. 3, the first and second intermediate sections 28 and 30 are spaced circumferentially from the airfoil 11. The mid-section 22 functions as a cutting tooth for cutting the groove 200A in the sealing structure 200.

The first outer surface 20A is defined by a first intermediate planar surface 22A, which forms part of the mid-section 22, and first and second generally curvilinear sections 40 and 42. The second outer surface 20B is defined by a second intermediate planar surface 22B, which also forms part of the mid-section 22, and third and fourth curvilinear sections 44 and 46. It is contemplated that the curvilinear sections 40, 42, 44 and 46 could alternatively be linear in shape or comprise a combination of linear and curvilinear portions.

The first curvilinear section 40 is generally parabolic in shape in a plane extending in the axial and circumferential directions A and C and extends from the first planar surface 22A to a first end face 224 of the sealing rail 20. The second curvilinear section 42 is generally parabolic in shape in the plane extending in the axial and circumferential directions A and C and extends from the first planar surface 22A to a second end face 226 of the sealing rail 20. The third curvilinear section 44 is generally parabolic in shape in the plane extending in the axial and circumferential directions A and C and extends from the second planar surface 22B to the first end face 224 of the sealing rail 20. The fourth curvilinear section 46 is generally parabolic in shape in the plane extending in the axial and circumferential directions A and C and extends from the second planar surface 22B to the second end face 226 of the sealing rail 20.

A thickness of the sealing rail 20 in an axial direction, see arrow A in FIG. 3 indicating an axial direction, varies such that the axial thickness decreases when moving along the rail 20 in the circumferential direction C from the mid-section 22 to one or both of the first and second opposing end sections 24 and 26. For example, the mid-section 22 has a first axial thickness $T_1$, the first intermediate section 28 has a second axial thickness $T_2$ and the first end section 24 has a third axial thickness $T_3$. The first axial thickness $T_1$ is greater than the second axial thickness $T_2$ and the second axial thickness $T_2$ is greater than the third axial thickness $T_3$. Further, the second intermediate section 30 has a fourth axial thickness $T_4$ and the second end section 26 has a fifth axial thickness $T_5$. The first axial thickness $T_1$ is greater than the fourth axial thickness $T_4$ and the fourth axial thickness $T_4$ is greater than the fifth axial thickness $T_5$. It is contemplated that the first axial thickness $T_1$ may be between about 20% to about 100% greater in size than the second and fourth axial thicknesses $T_2$ and $T_4$ and the second and fourth axial thicknesses $T_2$ and $T_4$ may be about 1% to about 30% greater in size than the third and fifth axial thicknesses $T_3$ and $T_5$.

It is noted that the mid-section 22, the widest portion of the sealing rail 20, is radially positioned in-line with the airfoil 11, see FIG. 3. Hence, the mass of the mid-section 22 is directly supported by the airfoil 11. Consequently, the mid-section 22 applies minimal or no centrifugal forces to the tip shroud 14 so as to cause the tip shroud 14 to bend radially outward.

During operation of the turbine, the shaft and disc assembly, including the row R of the blades 10, see FIG. 3, rotate at a high speed. As a result of this high speed rotation, outer circumferential end portions 14A and 14B of the shroud 14 tend to bend outwardly in a radial direction as a result of centrifugal forces acting upon the shroud 14. The sealing rail 20 functions as a stiffener member for the shroud 14 so as to reduce or prevent bending of the shroud end portions 14A and 14B outwardly in the radial direction. However, as the mass of the sealing rail 20 increases, stress at a fillet area 12A, see FIG. 2, between the airfoil 11 and the shroud 14, caused by centrifugal forces created by the mass of the shroud 14 and the sealing rail 20, increases. High stress at the fillet area 12 at high temperatures can result in premature failure at the interface between the airfoil 11 and the shroud 14. In the present invention, the first and second intermediate sections 28 and 30 and the first and second end sections 24 and 26 of the sealing rail 20 are each sized so as to have a sufficient axial thickness to provide sufficient support for the shroud 14 to substantially prevent radial bending from centrifugal forces acting upon the shroud 14. Such preferred thicknesses for the first and second intermediate sections 28 and 30 and the first and second end sections 24 and 26 of the sealing rail 20 can be determined by one skilled in the art using conventional mechanical engineering calculation rules and/or modeling software. Also in accordance with the present invention, the axial thickness of the rail 20 decreases in the circumferential direction C from the mid-section 22 to one or both of the first and second opposing end sections 24 and 26 so as to reduce the mass of the rail 20. By reducing sealing rail mass, stress at the fillet area 12A between the airfoil 11 and the shroud 14, caused by centrifugal forces created by the mass of the shroud 14 and the sealing rail 20, is reduced.

Figure 4:
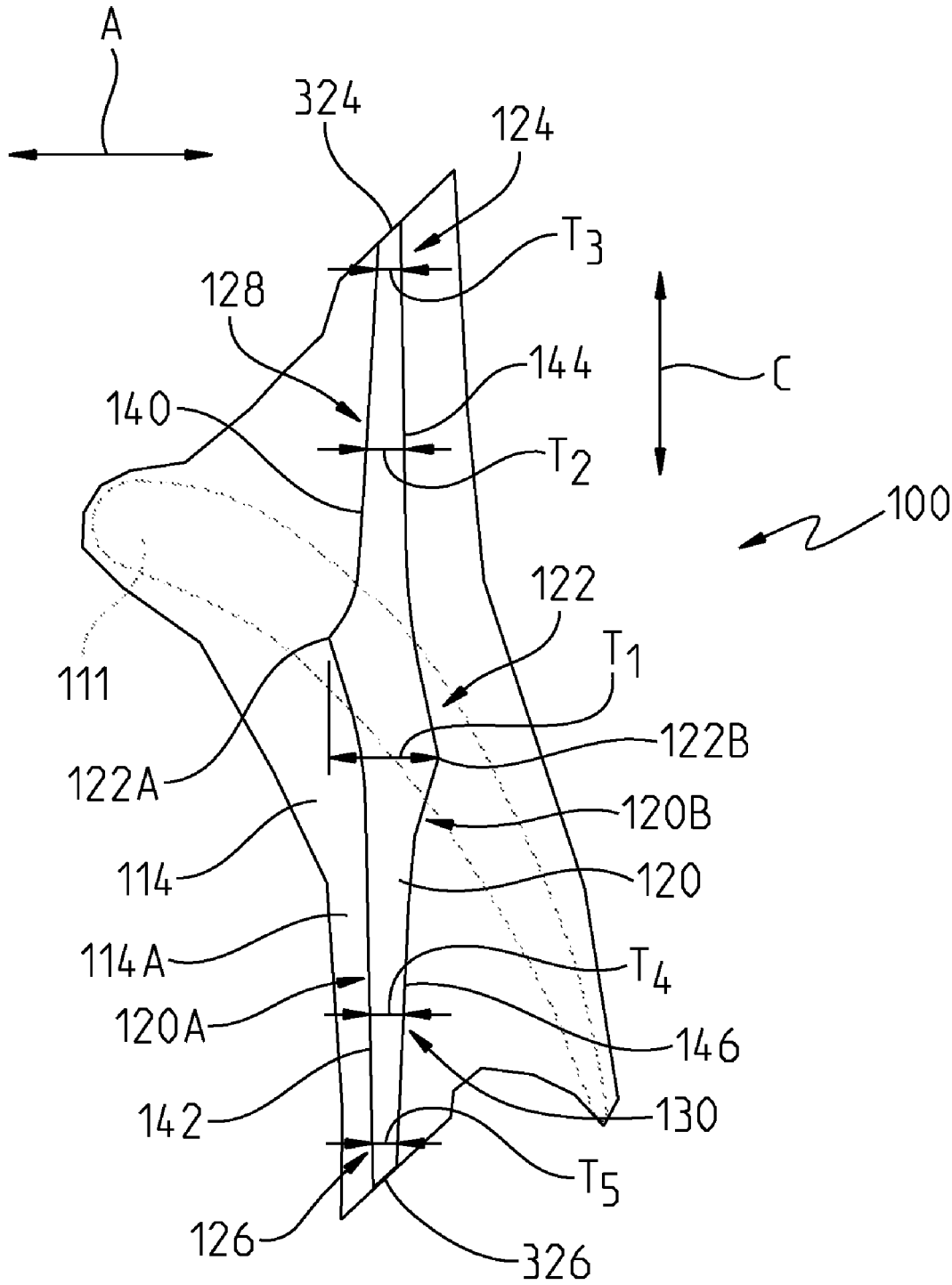
FIG. 4 is a top view of a blade including a sealing rail constructed in accordance with a second embodiment of the present invention.

Referring now to FIG. 4, a gas turbine blade 100 constructed in accordance with a second embodiment of the present invention is illustrated. The turbine blade 100 comprising an airfoil 111 including an upper end (not shown) and a lower end (not shown). A root (not shown) is coupled to the airfoil lower end. The blade 110 further comprises a tip shroud 114 coupled to the airfoil upper end. In the embodiment illustrated in FIG. 4, a single sealing rail 120 extends radially outwardly from an upper surface 114A of the shroud 114 and extends generally along a circumferential length of the shroud 114, see arrow C in FIG. 4 indicating a circumferential direction.

The sealing rail 120 comprises first and second outer surfaces 120A and 120B. The sealing rail 120 further comprises a mid-section 122, first and second opposing end sections 124 and 126, respectively, and first and second intermediate sections 128 and 130, respectively, located between the mid-section 122 and a corresponding one of the opposing end sections 124 and 126, see FIG. 4. As is apparent from FIG. 4, the first and second intermediate sections 128 and 130 are spaced circumferentially from the airfoil 111. The mid-section 122 functions as a cutting tooth for cutting a groove in a honeycomb sealing structure.

The first outer surface 120A is defined by a first point 122A, which forms part of the mid-section 122, and first and second curvilinear sections 140 and 142. The second outer surface 120B is defined by a point 122B, which also forms part of the mid-section 122, and third and fourth curvilinear sections 144 and 146. It is contemplated that the curvilinear sections 140, 142, 144 and 146 could alternatively be linear in shape or comprise a combination of linear and curvilinear portions.

The first curvilinear section 140 is generally parabolic in shape in a plane extending in the axial and circumferential directions A and C and extends from the first point 122A to a first end face 324 of the sealing rail 120. The second curvilinear section 142 is generally parabolic in shape in the plane extending in the axial and circumferential directions A and C and extends from the first point 122A to a second end face 326 of the sealing rail 120. The third curvilinear section 144 is generally parabolic in shape in the plane extending in the axial and circumferential directions A and C and extends from the second point 122B to the first end face 324 of the sealing rail 120. The fourth curvilinear section 146 is generally parabolic in shape in the plane extending in the axial and circumferential directions A and C and extends from the second point 122B to the second end face 326 of the sealing rail 120.

A thickness of the sealing rail 120 in an axial direction varies such that the axial thickness decreases when moving along the rail 120 in the circumferential direction C from the mid-section 122 to one or both of the first and second opposing end sections 124 and 126. For example, the mid-section 122 has a first axial thickness $T_1$, the first intermediate section 128 has a second axial thickness $T_2$ and the first end section 124 has a third axial thickness $T_3$. The first axial thickness $T_1$ is greater than the second axial thickness $T_2$ and the second axial thickness $T_2$ is greater than the third axial thickness $T_3$. Further, the second intermediate section 130 has a fourth axial thickness $T_4$ and the second end section 126 has a fifth axial thickness $T_5$. The first axial thickness $T_1$ is greater than the fourth axial thickness $T_4$ and the fourth axial thickness $T_4$ is greater than the fifth axial thickness $T_5$. It is contemplated that the first axial thickness $T_1$ may be between about 20% to about 100% greater in size than the second and fourth axial thicknesses $T_2$ and $T_4$ and the second and fourth axial thicknesses $T_2$ and $T_4$ may be about 1% to about 30% greater in size than the third and fifth axial thicknesses $T_3$ and $T_5$.

Figure 5:
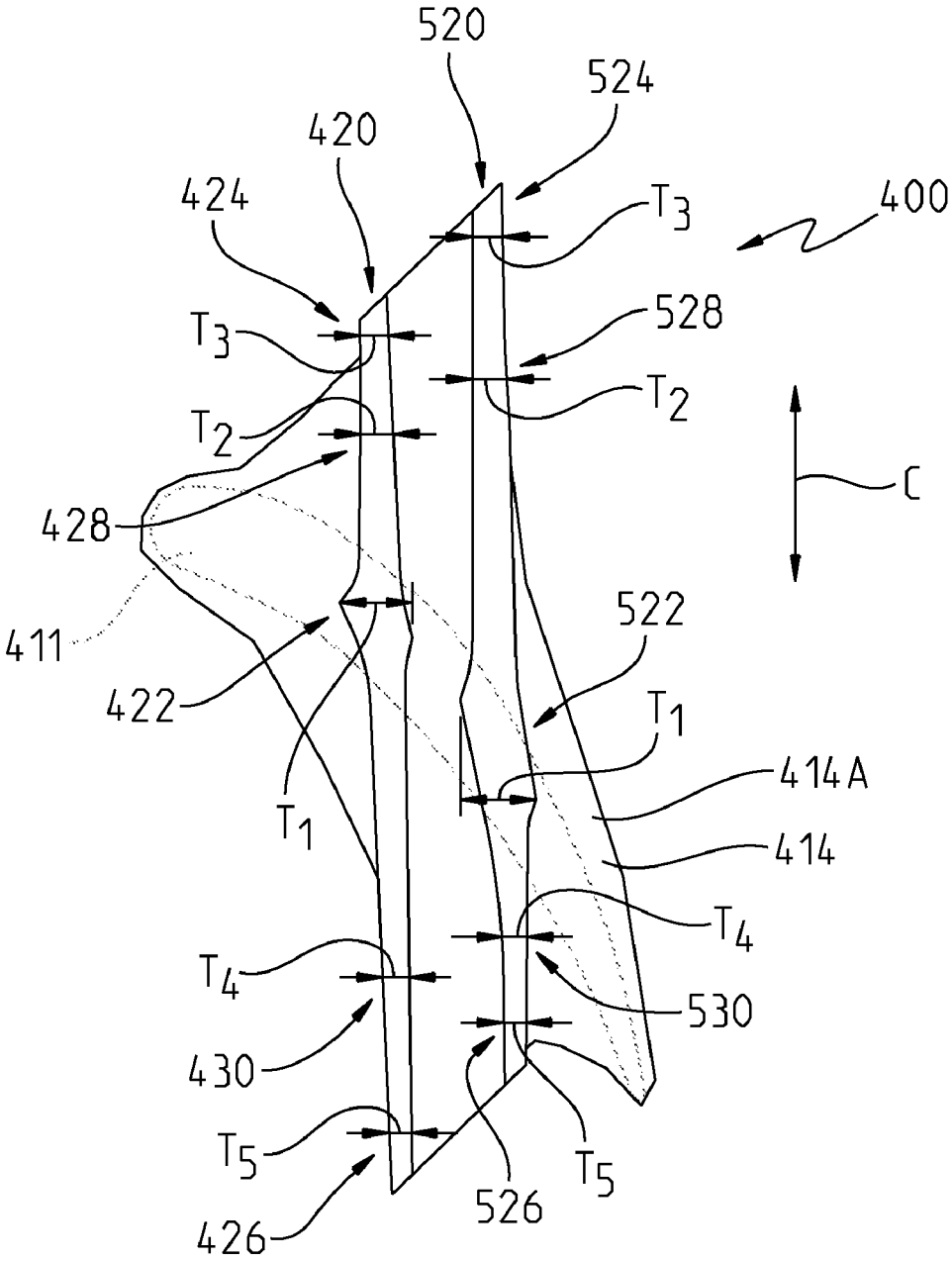
FIG. 5 is a top view of a blade including a sealing rail constructed in accordance with a third embodiment of the present invention.

Referring now to FIG. 5, a gas turbine blade 400 constructed in accordance with a third embodiment of the present invention is illustrated. The turbine blade 400 comprising an airfoil 411 including an upper end (not shown) and a lower end (not shown). A root (not shown) is coupled to the airfoil lower end. The blade 410 further comprises a tip shroud 414 coupled to the airfoil upper end. In the embodiment illustrated in FIG. 5, first and second sealing rails 420 and 520 extend radially outwardly from an upper surface 414A of the shroud 414 and extend generally along a circumferential length of the shroud 414, see arrow C in FIG. 5 indicating a circumferential direction. It is believed that providing two sealing rails is advantageous as they provide an improved hot gas sealing capability, they provide additional support so as to allow for a larger tip shroud, wherein a larger tip shroud provides additional protection for the engine casing from hot working gases and provides an additional reduction in hot working gases passing over the airfoil upper end.

Each of the first and second sealing rails 420 and 520 has a shape very similar to the shape of the sealing rail 120 illustrated in FIG. 4. It is also contemplated that one or both of the sealing rails 420 and 520 could have a shape similar to the shape of the sealing rail 20 illustrated in FIG. 3.

In the FIG. 5 embodiment, the first sealing rail 420 has an axial thickness that varies such that a mid-section 422 has a first thickness $T_1$, intermediate sections 428 and 430 have second and fourth thicknesses $T_2$ and $T_4$ and opposing end sections 424 and 426 have third and fifth thicknesses $T_3$ and $T_5$. The first thickness $T_1$ is greater than the second and fourth thicknesses $T_2$ and $T_4$ and the second and fourth thicknesses $T_2$ and $T_4$ are greater than the third and fifth thicknesses $T_3$ and $T_5$.

The second sealing rail 520 has an axial thickness that varies such that a mid-section 522 has a first thickness $T_1$, intermediate sections 528 and 530 have second and fourth thicknesses $T_2$ and $T_4$ and opposing end sections 524 and 526 have third and fifth thicknesses $T_3$ and $T_5$. The first thickness $T_1$ is greater than the second and fourth thicknesses $T_2$ and $T_4$ and the second and fourth thicknesses $T_2$ and $T_4$ are greater than the third and fifth thicknesses $T_3$ and $T_5$.

Both sealing rails 420 and 520 are adapted to be received in and move along corresponding grooves in a stationary honeycomb sealing structure.

Having described the invention in detail and by reference to preferred embodiments thereof, it will be apparent that modifications and variations are possible without departing from the scope of the invention defined in the appended claims.

What is claimed is:

1. A turbine blade comprising:

an airfoil including upper and lower ends;

a root coupled to said airfoil lower end, said root adapted to couple said blade to a rotatable disk;

a shroud coupled to said airfoil upper end; and at least one sealing rail extending radially outwardly from an upper surface of said shroud and extending generally along a circumferential length of said shroud, said sealing rail comprising a mid-section, opposing end sections and at least one intermediate section located between said mid-section and one of said opposing end sections and being spaced circumferentially from said airfoil, an axial thickness of said sealing rail varying such that said mid-section has a first thickness, said intermediate section has a second thickness and said one end section has a third thickness, said first thickness being greater than said second thickness and said second thickness being greater than said third thickness.

2. The turbine blade as set out in claim 1, wherein said sealing rail mid-section is radially positioned in-line with said airfoil.

3. The turbine blade as set out in claim 2, wherein said sealing rail mid-section comprises first and second generally planar surfaces spaced apart from one another in the axial direction.

4. The turbine blade as set out in claim 2, wherein said sealing rail has first and second outer surfaces, said first outer surface having first and second sections each having a generally parabolic shape in a plane extending in the axial and circumferential directions.

5. The turbine blade as set out in claim 4, wherein said first and second generally parabolic sections meet at a first point located at said mid-section.

6. The turbine blade as set out in claim 5, wherein said second outer surface having third and fourth sections each having a generally parabolic shape in the plane extending in the axial and circumferential directions.

7. The turbine blade as set out in claim 6, wherein said third and fourth generally parabolic sections meet at a second point located at said mid-section.

8. The turbine blade as set out in claim 7, wherein said first and second points are spaced apart from one another in the circumferential direction.

9. The turbine blade as set out in claim 1, wherein said at least one sealing rail comprises first and second sealing rails, each of said rails having an axial thickness varying such that a mid-section has a first thickness, an intermediate section has a second thickness and one of opposing end sections has a third thickness, said first thickness being greater than said second thickness and said second thickness being greater than said third thickness.

10. The turbine blade as set out in claim 1, wherein said intermediate section is located about mid-way between said mid-section and one of said opposing end sections.

11. A turbine comprising:

at least one row of circumferentially engaging tip shrouded blades, wherein each blade comprises:

an airfoil including upper and lower ends;

a root coupled to said airfoil lower end, said root adapted to couple said blade to a rotatable disk;

a shroud coupled to said airfoil upper end; and a first sealing rail extending radially outwardly from an upper surface of said shroud and extending generally along a circumferential length of said shroud, said first sealing rail comprising a mid-section, opposing end sections and at least one intermediate section located between said mid-section and one of said opposing end sections, an axial thickness of said first sealing rail varying such that said mid-section has a first thickness, said intermediate section has a second thickness and said one end section has a third thickness, said first thickness being greater than said second thickness and said second thickness being greater than said third thickness; and a second sealing rail extending radially outwardly from said upper surface of said shroud and extending generally along the circumferential length of said shroud, said second sealing rail comprising a mid-section, opposing end sections and at least one intermediate section located between said mid-section and one of said opposing end sections, an axial thickness of said second sealing rail varying such that said mid-section has a first thickness, said intermediate section has a second thickness and said one end section has a third thickness, said first thickness being greater than said second thickness and said second thickness being greater than said third thickness.

12. The turbine as set out in claim 11, wherein said sealing rail mid-section of each sealing rail is radially positioned in-line with said airfoil.

13. The turbine as set out in claim 12, wherein said sealing rail mid-section of each sealing rail comprises first and second generally planar surfaces spaced apart from one another in the axial direction.

14. The turbine as set out in claim 12, wherein each sealing rail has first and second outer surfaces, said first outer surface having first and second sections each having a generally parabolic shape in a plane extending in the axial and circumferential directions.

15. The turbine as set out in claim 14, wherein said first and second generally parabolic sections of each sealing rail meet at a first point located at said mid-section.

16. The turbine as set out in claim 15, wherein said second outer surface of each sealing rail having third and fourth sections each having a generally parabolic shape in the plane extending in the axial and circumferential directions.

17. The turbine as set out in claim 16, wherein said third and fourth generally parabolic sections of each sealing rail meet at a second point located at said mid-section.

18. The turbine as set out in claim 17, wherein said first and second points of each sealing rail are spaced apart from one another in the circumferential direction.

19. The turbine blade as set out in claim 11, wherein said intermediate section of each sealing rail is spaced circumferentially from said airfoil.

20. A turbine blade comprising:

an airfoil including upper and lower ends;

a root coupled to said airfoil lower end, said root adapted to couple said blade to a rotatable disk;

a shroud coupled to said airfoil upper end;

at least one sealing rail extending radially outwardly from an upper surface of said shroud and extending generally along a circumferential length of said shroud, said sealing rail comprising:

a mid-section comprising first and second generally planar surfaces spaced apart from one another in the axial direction;

opposing end sections; and at least one intermediate section located about mid-way between said mid-section and one of said opposing end sections; and wherein an axial thickness of said sealing rail varies such that said mid-section has a first thickness, said intermediate section has a second thickness and said one end section has a third thickness, said first thickness being greater than said second thickness and said second thickness being greater than said third thickness.

* * * * *